US006801179B2

(12) United States Patent
Dalal

(10) Patent No.: US 6,801,179 B2
(45) Date of Patent: Oct. 5, 2004

(54) LIQUID CRYSTAL DISPLAY DEVICE HAVING INVERSION FLICKER COMPENSATION

(75) Inventor: Sandeep M. Dalal, Ossining, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 441 days.

(21) Appl. No.: 09/947,814

(22) Filed: Sep. 6, 2001

(65) Prior Publication Data

US 2003/0043168 A1 Mar. 6, 2003

(51) Int. Cl.[7] ..... G09G 3/36

(52) U.S. Cl. ..... 345/89; 345/96; 345/690; 348/254; 348/255

(58) Field of Search ..... 345/88, 89, 94–96, 345/209, 690; 348/254–256, 674–677

(56) References Cited

U.S. PATENT DOCUMENTS

| | | | | |
|---|---|---|---|---|
| 5,604,511 A | | 2/1997 | Ohi | 345/98 |
| 5,748,171 A | | 5/1998 | Ishizaki et al. | 345/101 |
| 5,754,150 A | * | 5/1998 | Matsui | 345/89 |
| 5,847,688 A | * | 12/1998 | Ohi et al. | 345/98 |
| 6,049,321 A | * | 4/2000 | Sasaki | 345/99 |
| 6,144,354 A | * | 11/2000 | Koyama et al. | 345/98 |

FOREIGN PATENT DOCUMENTS

| | | | |
|---|---|---|---|
| EP | 0915453 A1 | 5/1999 | G09G/3/36 |
| EP | 0917128 A1 | 5/1999 | G09G/3/36 |
| EP | 1126726 A2 | 8/2001 | H04N/9/73 |

OTHER PUBLICATIONS

Patent Abstracts of Japan, Publication No. 2001100711, Publication date Apr. 13, 2001, "Source Driver, Source Line Driving Circuit and Liquid Crystal Display Device Using the Circuit".

Patent Abstracts of Japan, Publication No. 11352933, Publication date Jun. 4, 1998, "Liquid Crystal Display Device".

Patent Abstracts of Japan, Publication No. 0712144, Publication date Oct. 20, 1993, "Liquid Crystal Display Device".

* cited by examiner

*Primary Examiner*—Amare Mengistu
*Assistant Examiner*—Tom Sheng

(57) ABSTRACT

A display driver for implementing an inversion flicker compensation method is disclosed. The inversion flicker compensation method is applicable to a liquid crystal display device that is operable to emit a luminous output in response to a reception of a voltage drive signal and a voltage reference signal. The display driver is operated in accordance with the method to provide the voltage drive signal to the liquid crystal display device in response to a reception of a voltage data signal having a data voltage level indicative of a gray level of a color component. The display driver includes a gamma lookup table for the voltage drive signal that lists a pair of drive voltage levels for the voltage drive signal that correspond to the gray level as indicated by the data voltage level of the voltage data signal. The drive voltage levels have opposing polarities relative to a reference voltage level of the voltage reference signal.

9 Claims, 12 Drawing Sheets

LIQUID CRYSTAL DISPLAY DEVICE HAVING INVERSION FLICKER COMPENSATION

BACKGROUND OF THE INVENTION

1. Field of the Invention

The present invention generally relates to video display devices. The present invention specifically relates to a construction of gamma lookup tables for providing inversion flicker compensation to a liquid crystal display device.

2. Description of the Related Art

FIG. 1 illustrates a conventional LCD device 13 for transmitting a luminous output 14 in response to voltage drive signals $V_{AS4-AS6}$ in analog form. FIG. 2 illustrates an exemplary luminance transmission percentage of luminous output 14 in terms of a red color component, a green color component, and a blue color component as a function of various levels of voltage drive signals $V_{AS4-AS6}$. As known in the art, each drive voltage signal $V_{AS4-AS6}$ is applied to each column (not shown) of corresponding LCD panels (not shown) of LCD device 13. Each column is connected via a transistor (not shown) to each pixel (not shown) in each row (not shown) of each LCD panel. LCD device 13 also includes a top plate (not shown) known as a counter electrode for each LCD panel. Each counter electrode receives a voltage reference signal $V_{REF}$ in analog form.

For the liquid crystal material within each pixel of each LCD panel to operate properly, the level of drive voltage signals $V_{AS4-AS6}$ are modulated relative to voltage reference signal $V_{REF}$. For example, if voltage reference signal $V_{REF}$ has a level of six (6) volts, then the levels of voltage drive signals $V_{AS4-AS6}$ traverse a range from zero (0) volts to twelve (12) volts as shown in FIG. 2. A low inversion polarity range for voltage drive signals $V_{AS4-AS6}$ is between zero (0) volts and six (6) volts. A high inversion polarity range for voltage drive signals $V_{AS4-AS6}$ is between six (6) volts and twelve (12) volts. Frame inversion implies the levels of voltage drive signals $V_{AS4-AS6}$ are within the low inversion polarity range for one video frame, the levels of voltage drive signals $V_{AS4-AS6}$ are within the high inversion polarity range for a successive video frame, and so on, and so on.

Gamma circuit 10 includes conventional gamma lookup tables (not shown) for facilitating a reception of voltage drive signals $V_{AS4-AS6}$ by LCD device 13 whereby, as shown in FIG. 3, LCD device 13 transmits luminous output 14 at a desired luminance response as related to voltage data signal $V_{DS1-DS3}$ in digital form. Voltage data signal $V_{DS1-DS3}$ are indicative of a particular gray level input from a conventional video source (not shown) as related to the red color component, the green color component, and the blue color component, respectively. For example, voltage data signal $V_{DS1-DS3}$ can consist of eight bits representing 256 gray levels over a range of 00000000 (normalized as 0 in FIG. 3) to 11111111 (normalized as 1 in FIG. 3).

In response to a reception of voltage data signal $V_{DS1-DS3}$, gamma circuit 10 obtains levels for voltage drive signals $V_{AS4-AS6}$ for the low inversion polarity range that corresponds to the levels of voltage data signal $V_{DS1-DS3}$, respectively. A digital-to-analog converter (DAC) 11 transform voltage data signal $V_{DS1-DS3}$ to voltage drive signals $V_{AS1-AS3}$, respectively, in analog form that is only provided with levels within the low inversion polarity range based on an average luminance response of luminous output 14 in both inversion polarity ranges. Thus, to achieve frame inversion, a voltage inversion circuit 12 provides voltage drive signals $V_{AS4-AS6}$ in response to voltage drive signals $V_{AS1-AS3}$, respectively, with the levels of voltage drive signals $V_{AS4-AS6}$ being within the low inversion polarity range (e.g., equating control voltage $V_{AS1}$) for one video frame, the levels of voltage drive signals $V_{AS4-AS6}$ being within the high inversion polarity range (e.g., $(2*V_{REF})-V_{AS1}$) for a successive video frame, and so on, and so on.

Luminous output 14 experiences an inversion flicker whenever one or more voltage drive signals $V_{AS4-AS6}$ are attenuated prior to being applied to the appropriate pixels with LCD device 13. As known in the art, such attenuation typically occurs within conventional LCD device 13 whenever levels of voltage drive signals $V_{AS4-AS6}$ are within the high inversion polarity range. Consequently, as exemplary illustrated in FIG. 4, a time-based amplitude measurement of luminous output 14 as related to each gray level input indicated by the levels of the voltage data signals $V_{DS1-DS3}$ would exhibit uneven peaks relative to an average luminous response of luminous output 14 with the uneven peaks being representative of the inversion flicker.

Clearly, a disadvantage of employing gamma circuit 10, DAC 11, and voltage inversion circuit 12 to drive LCD device 13 is the failure to compensate for any occurrence of an inversion flicker of luminous output 14. Therefore, there is a need to provide a method and a device for eliminating inversion flicker within LCD device 13. The present invention addresses this need.

SUMMARY OF THE INVENTION

The present invention relates to a method and a device for eliminating inversion flicker within a LCD device. Various aspects of the present invention are novel, non-obvious, and provide various advantages. While the actual nature of the present invention covered herein can only be determined with reference to the claims appended hereto, certain features, which are characteristic of the embodiments disclosed herein, are described briefly as follows.

A first form of the present invention is a device comprising a LCD device operable to emit a luminous output in response to a reception of a voltage drive signal and a voltage reference signal. The device further comprises a display driver operable to provide the voltage drive signal to the LCD device in response to a reception of a voltage data signal having a data voltage level indicative of a gray level. The display driver includes a gamma lookup table for the voltage drive signal with the gamma lookup table listing a pair of drive voltage levels for the voltage drive signal that correspond to the gray level as indicated by a data voltage level of the voltage data signal. The drive voltage levels for the voltage drive signal have opposing polarities relative to a reference voltage level of the voltage reference signal.

A second form of the present invention is a method for applying an inversion flicker compensation to a luminous output being emitted by a liquid crystal display device in response to a reception of a voltage drive signal and a voltage reference signal. First, a display driver is operated to receive a voltage data signal having a data voltage level indicative of a first gray level. Second, the display driver is operated to obtain a pair of drive voltage levels for the voltage drive signal in response to the reception of the voltage data signal having the data voltage level. The pair of drive voltage levels having opposing polarities relative to a reference voltage level of the voltage reference signal. Finally, the display driver is operated to provide the voltage drive signal to the liquid crystal display device in a frame inversion manner involving the pair of drive voltage levels during a duration of the data voltage level indicating the first gray level.

The foregoing forms and other forms, features and advantages of the present invention will become further apparent from the following detailed description of the presently preferred embodiments, read in conjunction with the accompanying drawings. The detailed description and drawings are merely illustrative of the present invention rather than limiting, the scope of the present invention being defined by the appended claims and equivalents thereof.

DETAILED DESCRIPTION OF THE PRESENTLY PREFERRED EMBODIMENTS

Figure 5:
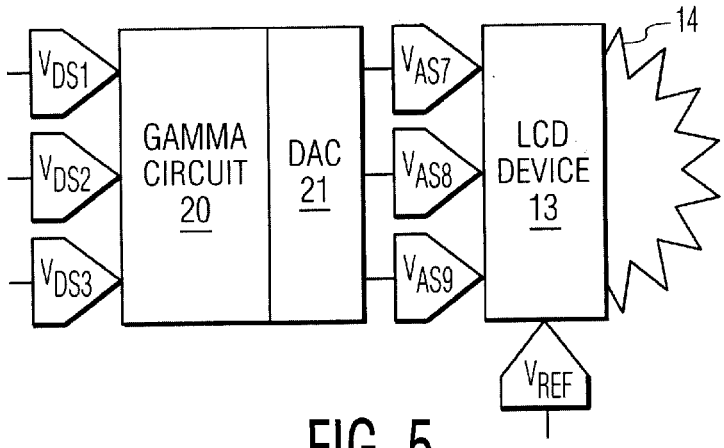
FIG. 5 is a block diagram of a display driver in accordance with the present invention that is employed to drive the FIG. 1 LCD device.
Figure 6A:
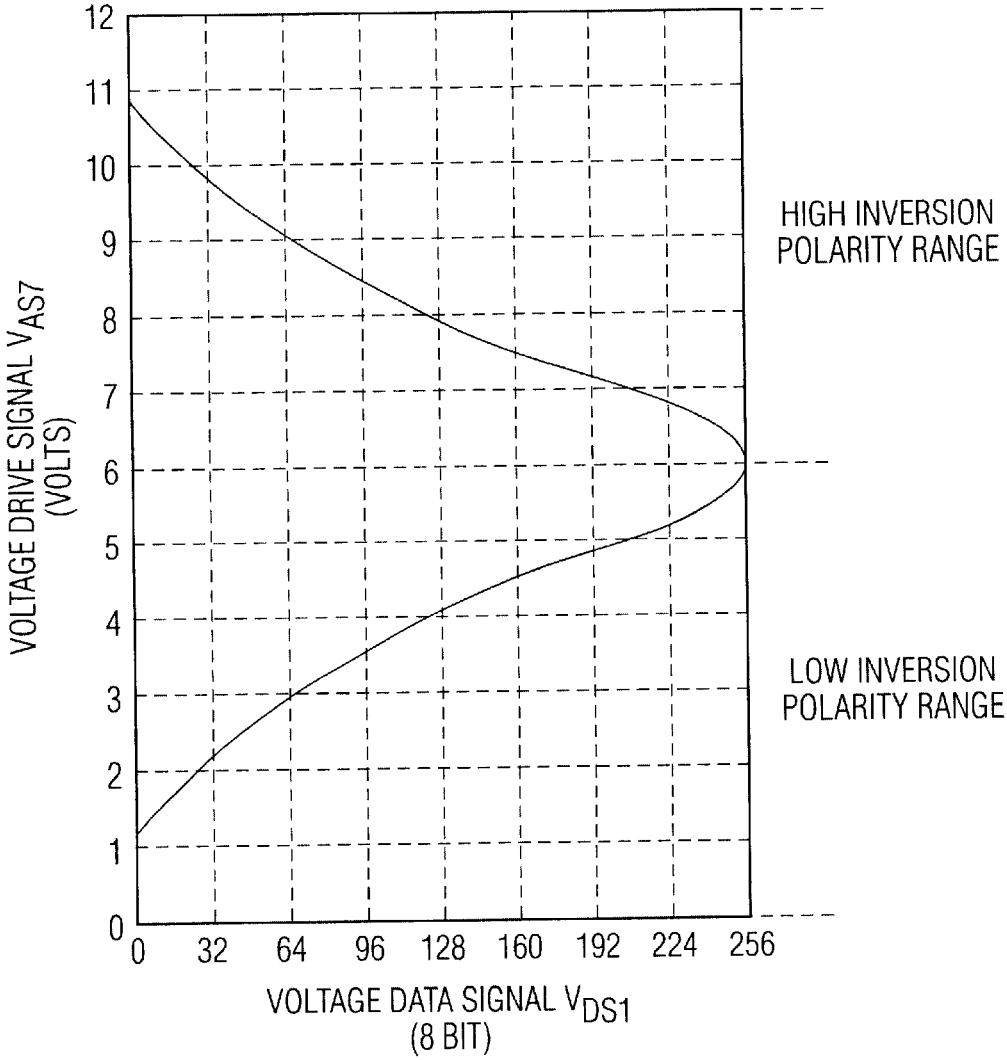
FIG. 6A is an exemplary red color gamma lookup table in accordance with the present invention relating data voltage levels of a voltage data signal from a video source to drive voltage levels of a voltage drive signal to the FIG. 1 LCD device.
Figure 6B:
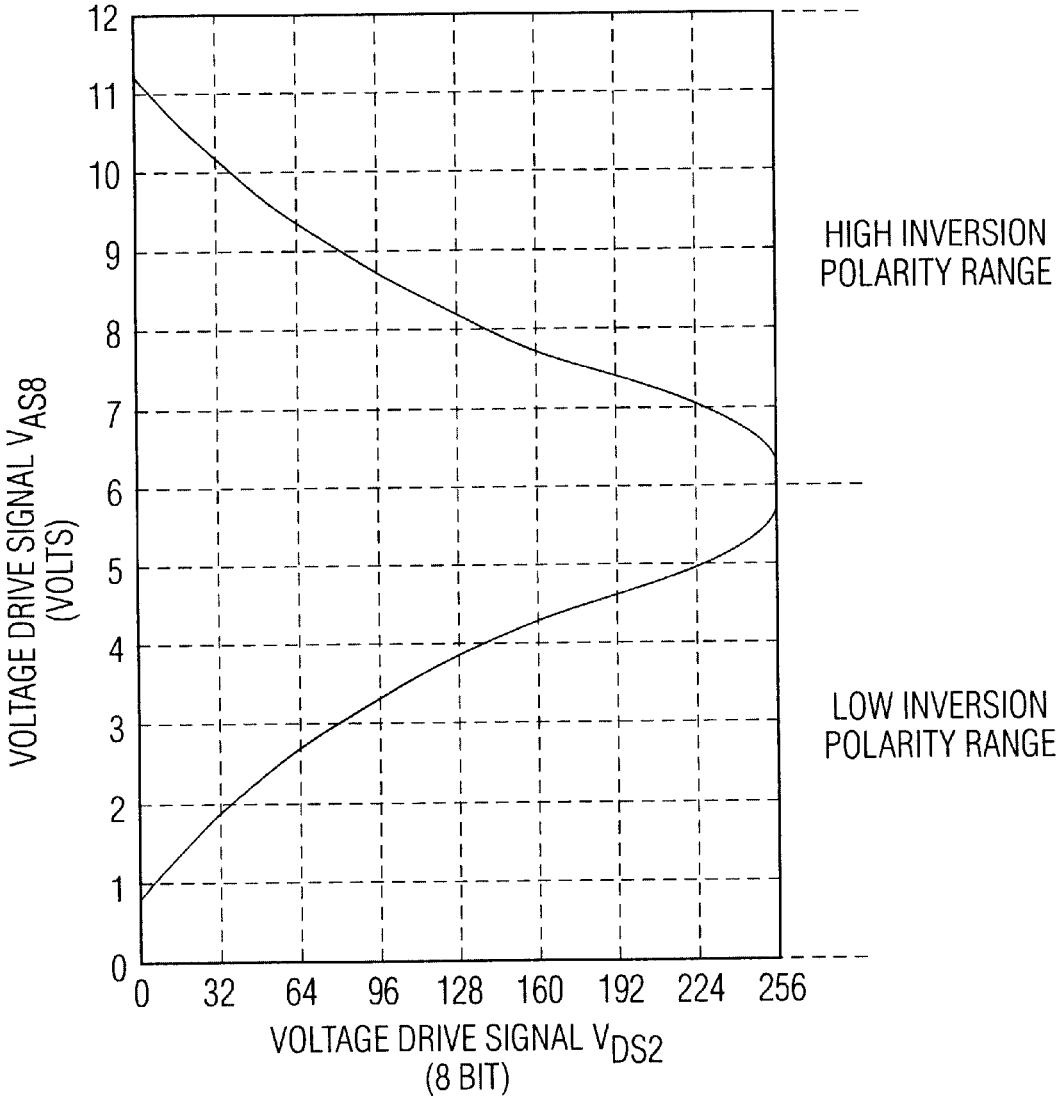
FIG. 6B is an exemplary green color gamma lookup table in accordance with the present invention relating data voltage levels of a voltage data signal from a video source to drive voltage levels of a voltage drive signal to the FIG. 1 LCD device.
Figure 6C:
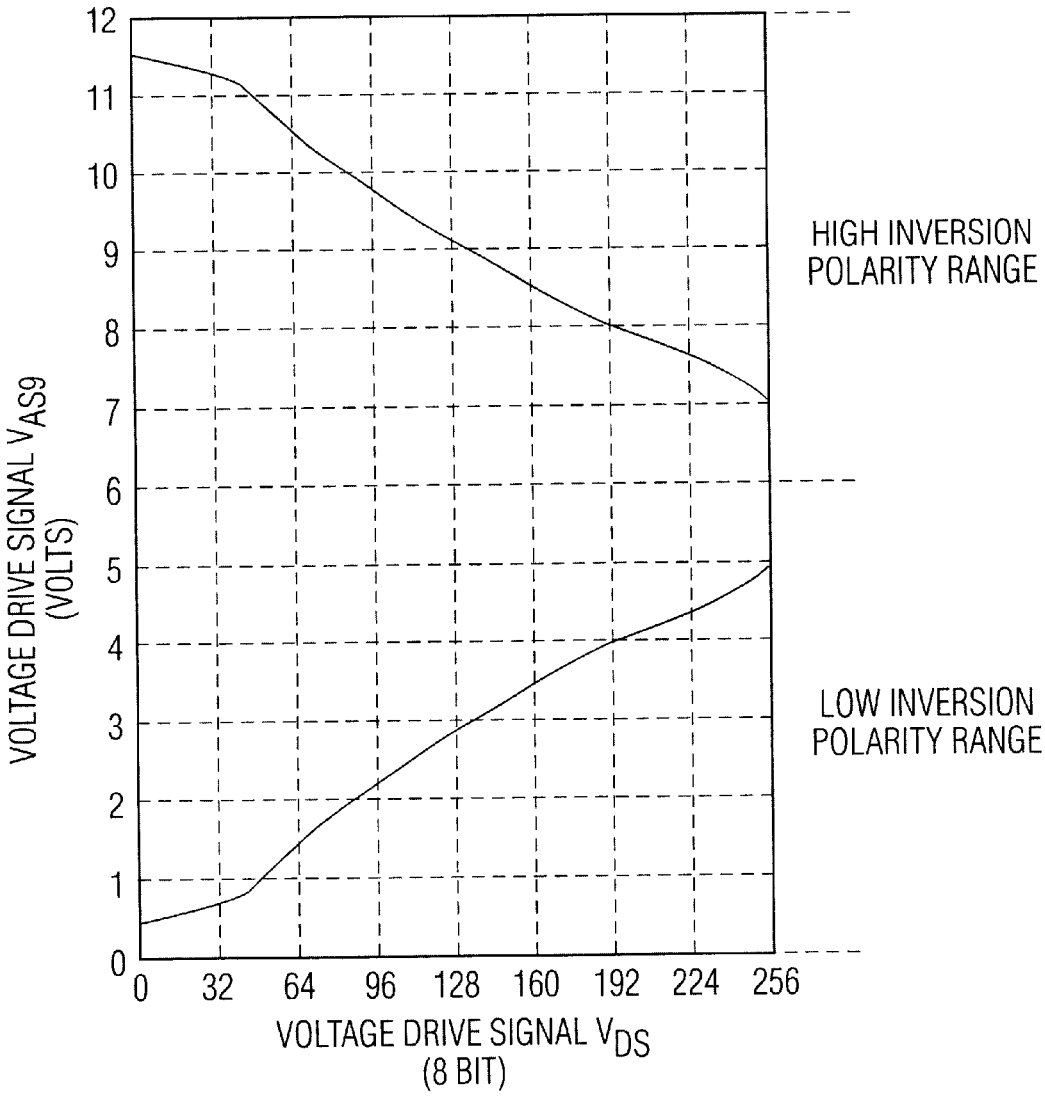
FIG. 6C is an exemplary blue color gamma lookup table in accordance with the present invention relating data voltage levels of a voltage data signal from a video source to drive voltage levels of a voltage drive signal to the FIG. 1 LCD device.

FIG. 5 illustrates a display driver of the present invention comprising a gamma circuit 20 and a digital-to-analog converter (DAC) 21. Gamma circuit 20 includes gamma lookup tables for a red color component, a green color component, and a blue color component in accordance with the principles of the present invention. FIG. 6A illustrates an exemplary illustration of a red color gamma lookup table listing a pair of drive voltage levels of a drive voltage signal $V_{AS7}$ having opposing polarities relative to a reference voltage level (6 volts) of reference voltage signal $V_{REF}$ for each graylevel input indicated by a data voltage level of voltage data signal $V_{DS1}$. FIG. 6B illustrates an exemplary illustration of a green color gamma lookup table listing a pair of drive voltage levels of a drive voltage signal $V_{AS8}$ having opposing polarities relative to a reference voltage level (6 volts) of reference voltage signal $V_{REF}$ for each graylevel input indicated by a data voltage level of voltage data signal $V_{DS2}$. FIG. 6C illustrates an exemplary illustration of a blue color gamma lookup table listing a pair of drive voltage levels of a drive voltage signal $V_{AS9}$ having opposing polarities relative to a reference voltage level (6 volts) of reference voltage signal $V_{REF}$ for each graylevel input indicated by a data voltage level of voltage data signal $V_{DS3}$.

The gamma lookup tables of FIGS. 6A–6C reflect an inversion flicker compensation for luminous output 14 as emitted by LCD device 13. Specifically, gamma circuit 20 obtains the appropriate pairs of drive voltage levels for voltage drive signals $V_{AS7\text{-}AS9}$ as related to the data voltage levels of voltage drive signals $V_{DS1\text{-}DS2}$, respectively. For example, as shown in FIG. 6A, gamma circuit 20 would obtain drive voltage levels of approximately four (4) volts and eight (8) volts when the data voltage level of voltage data signal $V_{DS1}$ indicates a gray level of 127.

DAC 21 transforms voltage data signals $V_{DS1\text{-}DS3}$ into voltage drive signals $V_{AS7\text{-}AS9}$, respectively, in accordance with the appropriate pairs of drive voltage levels obtained from the gamma lookup tables, and provides voltage drive signals $V_{AS7\text{-}AS9}$ to LCD device 13 in a frame inversion manner. For example, DAC 21 would transform voltage data signal $V_{DS1}$ having a data voltage level indicating a gray level of 127 for the red color component into voltage drive signal $V_{AS7}$ having a drive voltage level of approximately four (4) volts for one video frame, a drive voltage level of approximately eight (8) volts for a successive video frame, and so on, and so on. This frame inversion would continue until the data voltage level of voltage data signal $V_{DS1}$ was increased or decreased to indicate a different gray level of the red color component.

In response to a reception of voltage drive signals $V_{AS7\text{-}AS9}$, LCD device 13 emits luminous output 14 without luminous output 14 experiencing any inversion flicker. The inversion flicker compensation is maintained as the data voltage level(s) of one or more of voltage data signals $V_{DS1\text{-}DS3}$ are increased or decreased to indicated a different gray level of the corresponding color component.

More or less gamma lookup tables as well as gamma lookup tables for other color components may be utilized in other embodiments of a display drive in accordance with the present invention.

Figure 7A:
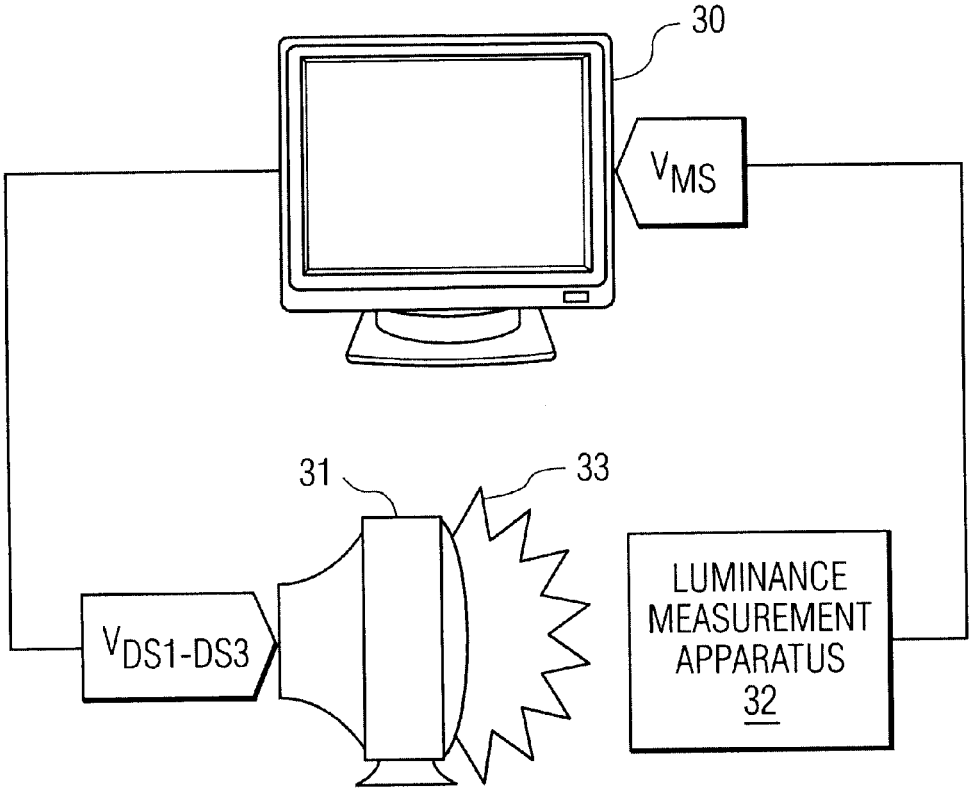
FIG. 7A illustrates a system in accordance with the present invention for generating the FIGS. 6A–6C gamma lookup tables.
Figure 7B:
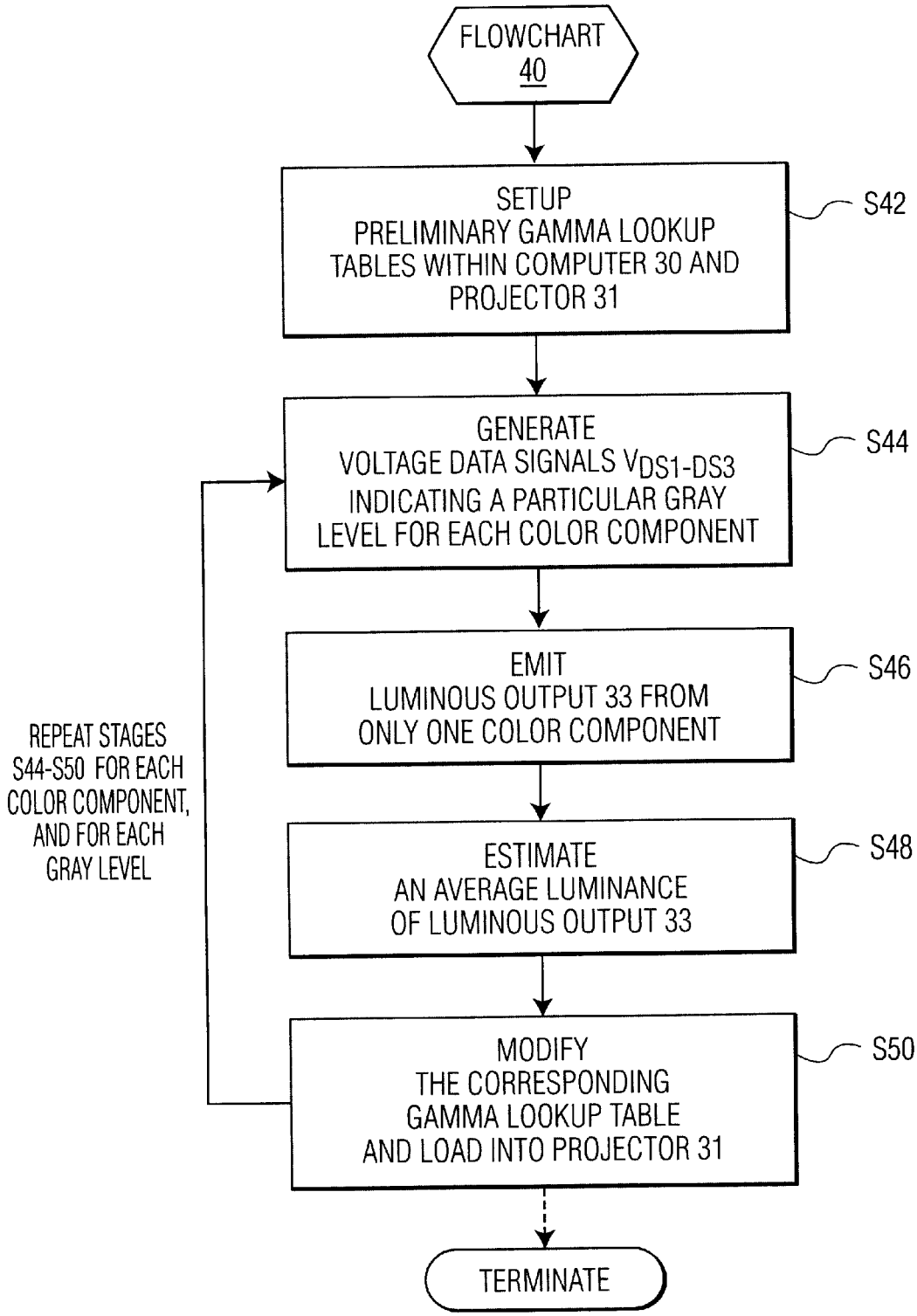
FIG. 7B illustrates a flowchart of a method in accordance with the present invention for generating the FIGS. 6A–6C gamma lookup tables.
Figure 8A:
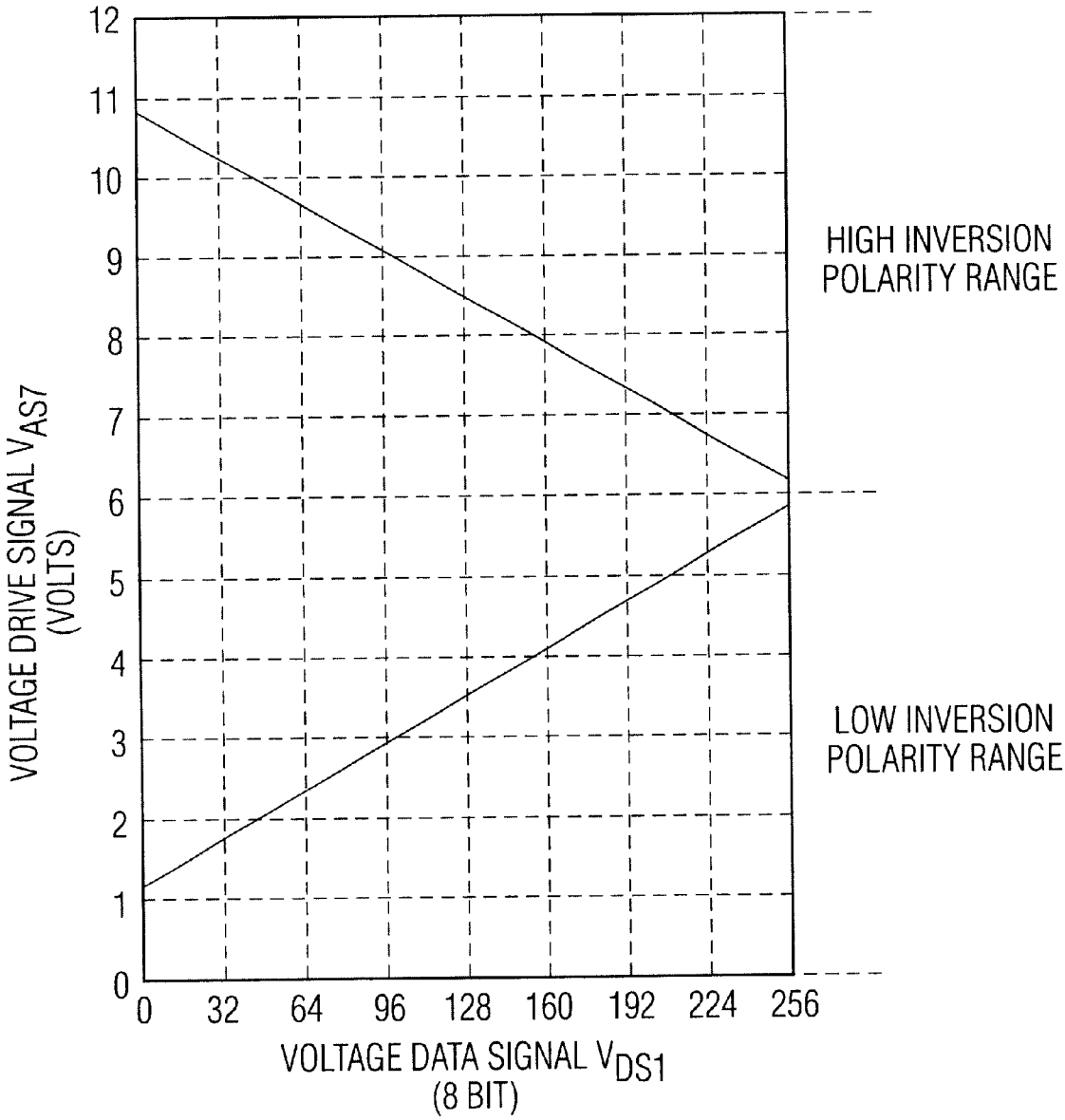
FIG. 8A is an exemplary red color gamma lookup table in accordance with the present invention relating to a black voltage input level and a white voltage input level of a voltage data signal to corresponding drive voltage levels of a voltage drive signal.

A system of the present invention as illustrated in FIG. 7A implements a method of the present invention as represented by a flowchart 40 illustrated in FIG. 7B for constructing the gamma lookup tables for gamma circuit 20. During a stage S42 of flowchart 40, preliminary gamma lookup tables for each color component are setup by a computer 30 (e.g., any type of personal computer or workstation) and loaded into a conventional projector 31. FIG. 8A illustrates an exemplary preliminary red color gamma lookup table having a linear relationship between the drive voltage levels of voltage drive signal $V_{AS7}$ and the data voltage levels of voltage data signal $V_{DS1}$, based upon previously established drive voltage levels of voltage drive signal $V_{AS7}$ corresponding to a data voltage level of 0 for voltage data signal $V_{DS1}$ and previously established drive voltage levels of voltage drive signal $V_{AS7}$ corresponding to a data voltage level of 255 for voltage data signal $V_{DS1}$. The previously established drive voltage levels of 0 and 255 correspond to the black voltage and the white voltage, respectively, for the red color.

Figure 8B:
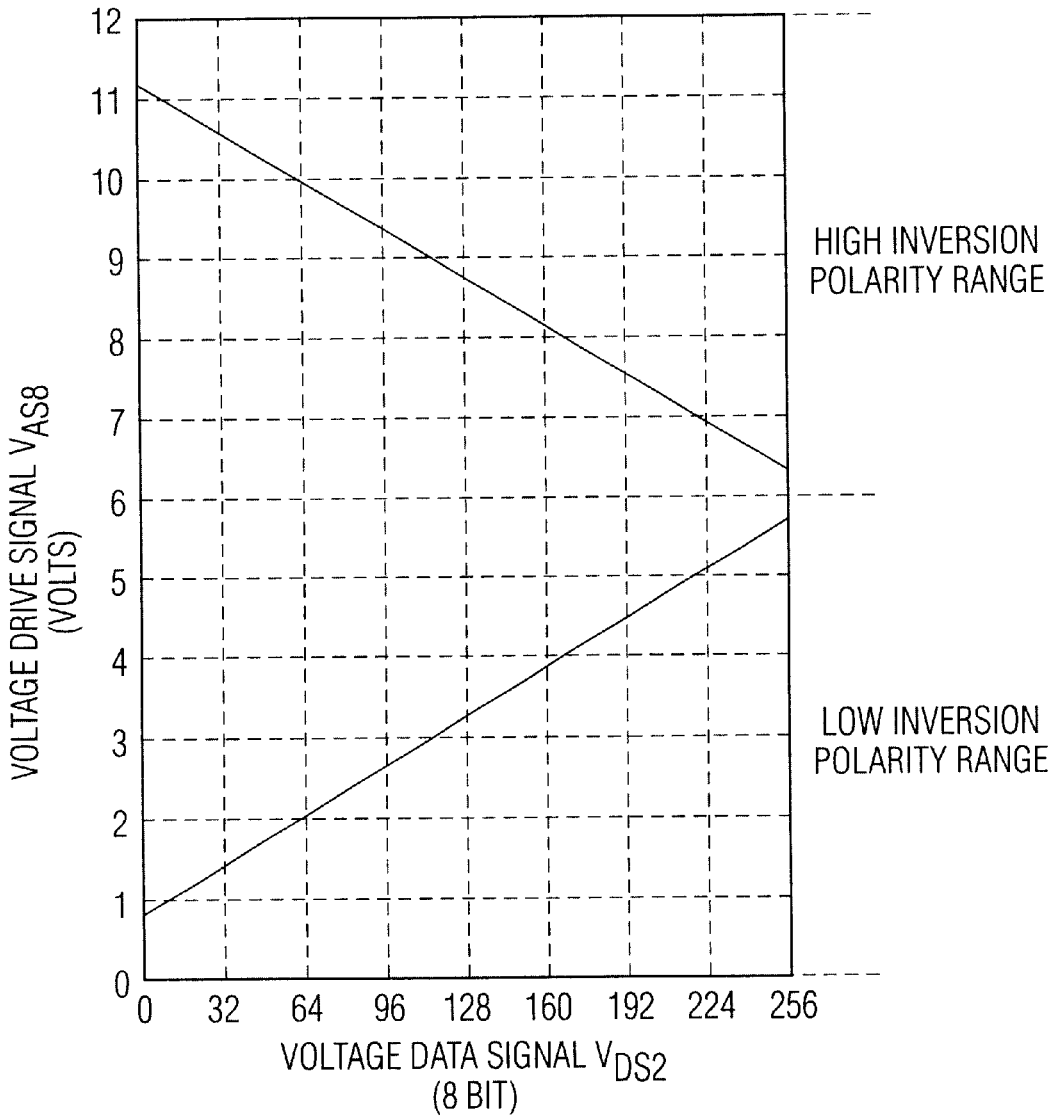
FIG. 8B is an exemplary green color gamma lookup table in accordance with the present invention relating to a black voltage input level and a white voltage input level of a voltage data signal to corresponding drive voltage levels of a voltage drive signal.

FIG. 8B illustrates an exemplary preliminary green color gamma lookup table having a linear relationship between the drive voltage levels of voltage drive signal $V_{AS8}$ and the data voltage levels of voltage data signal $V_{DS2}$ based upon previously established drive voltage levels of voltage drive signal $V_{AS8}$ corresponding to a data voltage level of 0 for voltage data signal $V_{DS2}$ and previously established drive voltage levels of voltage drive signal $V_{AS8}$ corresponding to a data voltage level of 255 for voltage data signal $V_{DS2}$. The previously established drive voltage levels of 0 and 255 correspond to the black voltage and the white voltage, respectively, for the green color.

Figure 8C:
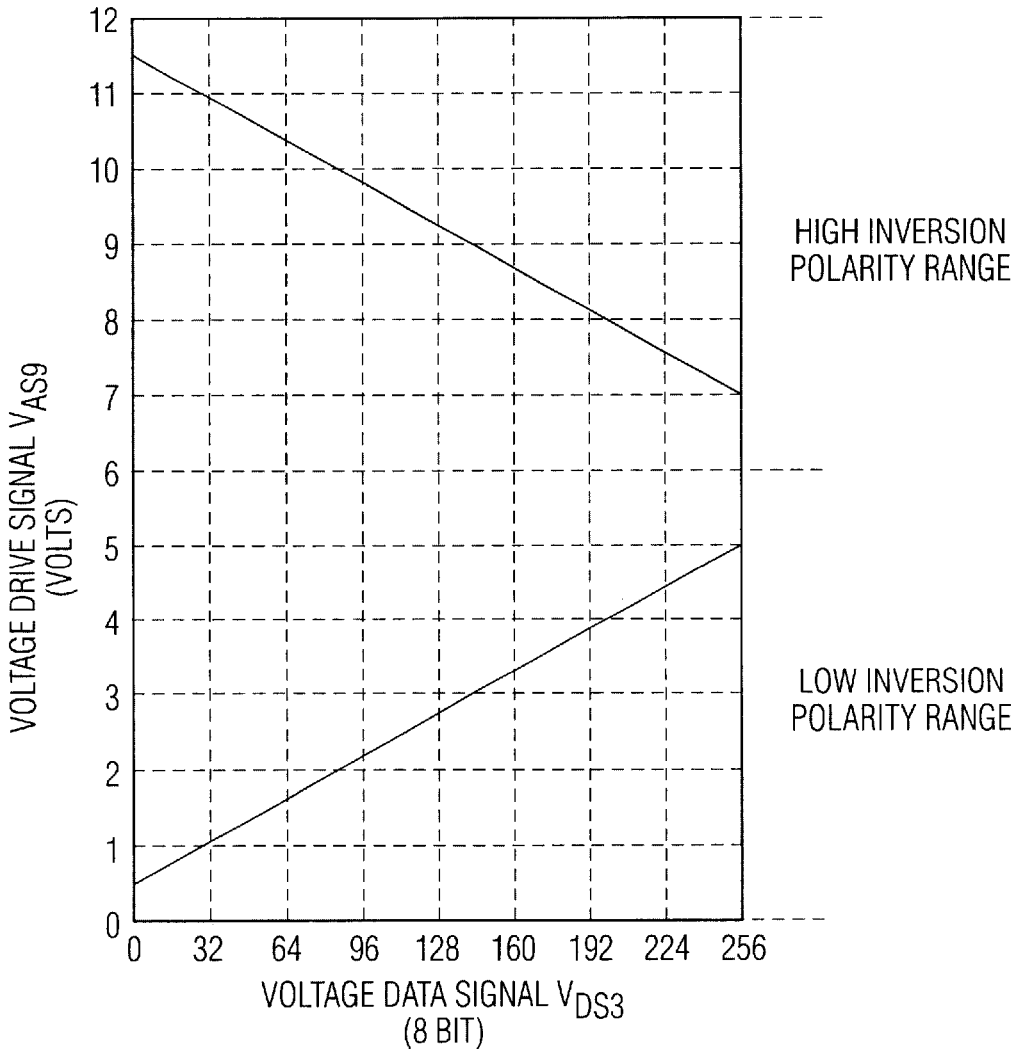
FIG. 8C is an exemplary blue color gamma lookup table in accordance with the present invention relating to a black voltage input level and a white voltage input level of a voltage data signal to corresponding drive voltage levels of a voltage drive signal.

FIG. 8C illustrates an exemplary preliminary blue color gamma lookup table having a linear relationship between the drive voltage levels of voltage drive signal $V_{AS9}$ and the data voltage levels of voltage data signal $V_{DS3}$ based upon previously established drive voltage levels of voltage drive signal $V_{AS9}$ corresponding to a data voltage level of 0 for voltage data signal $V_{DS3}$ and previously established drive voltage levels of voltage drive signal $V_{AS9}$ corresponding to a data voltage level of 255 for voltage data signal $V_{DS3}$. The previously established drive voltage levels of 0 and 255 correspond to the black voltage and the white voltage, respectively, for the blue color.

Referring again to FIGS. 7A and 7B, during a stage S44 of flowchart 40, a computer 30 is operated to generate voltage data signals $V_{DS1\text{-}DS3}$ having data voltage magnitudes indicating a gray level for the red color component, the green color component, and the blue color component, respectively. For example, during an initial execution of stage S44, computer 30 can be operated to generate voltage data signals $V_{DS1\text{-}DS3}$ having data voltage magnitudes indicating a gray level of 0 for the red color component, the green color component, and the blue color component, respectively.

During a stage S46 of flowchart 40, projector 31 is operated to emit luminous output 33 from only one of the color components in a frame inversion manner. This can be accomplished by having projector 31 blank out the other two color components. For example, during an initial execution of stage S46, projector 31 can be operated to blank out the green color component and the blue color component whereby the luminous output 33 is based solely on the red color component.

Figure 9:
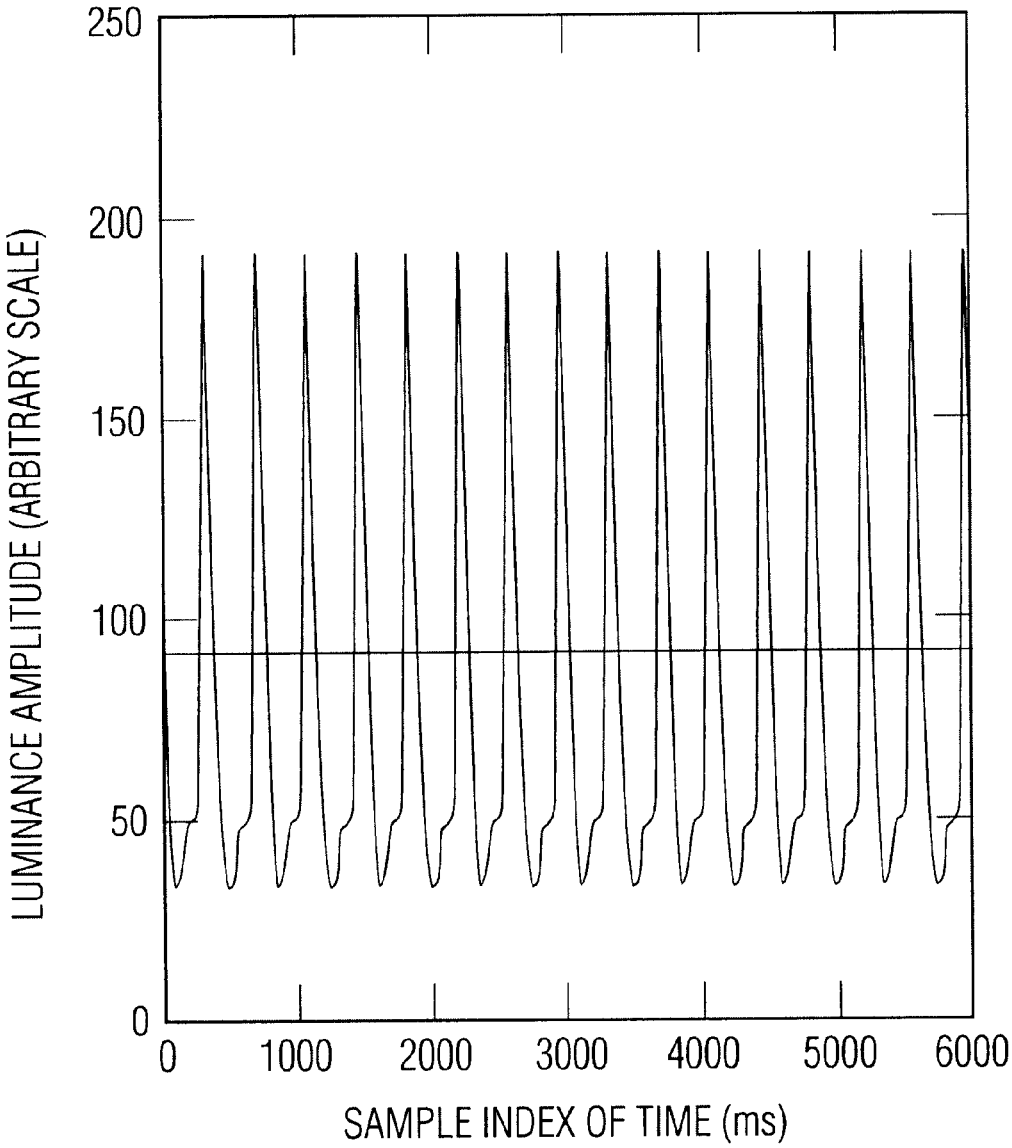
FIG. 9 is illustrates an exemplary time-based luminance amplitude measurement of a luminance output of a FIG. 7 projector as related to a gray level input indicated by a voltage data signal.

During a stage S48 of flowchart 40, a conventional luminous measurement apparatus 32 is operated to estimate an average luminance luminous output 33 per frame. In one embodiment, luminous measurement apparatus 32 includes a photodiode having a photometric filter to perform multiple measurements of luminous output 33 within one frame, and a data acquisition card to convert each measurement from analog form to digital form. Luminous measurement apparatus 32 averages the measurements over the frame to obtain a smooth and reliable estimate of the average luminance measured within the frame, and provides a voltage measurement signal VMS having a measure voltage level indicative of the average luminance as estimated. For example, FIG. 9 illustrates a time-based amplitude measurements of luminous output 33 having an average luminance represented by the horizontal line.

Figure 1:
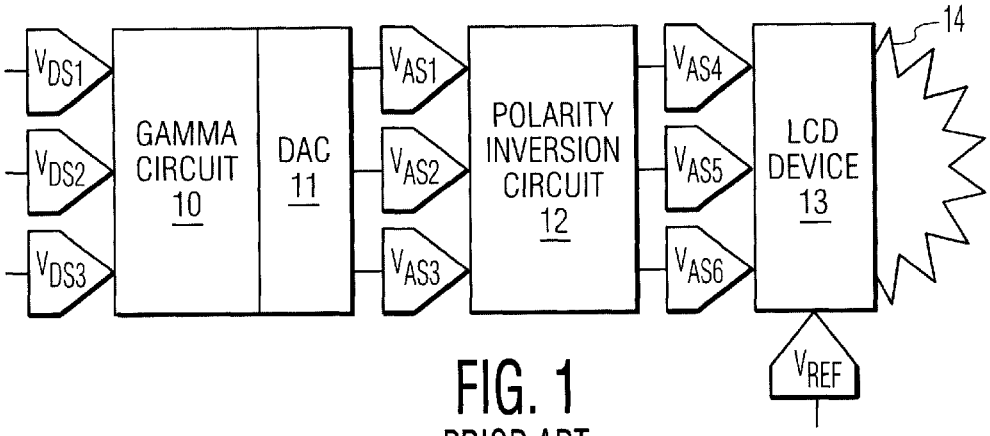
FIG. 1 PRIOR ART
FIG. 1 is a block diagram of a conventional display driver employed to drive a liquid crystal display (LCD) device.
Figure 2:
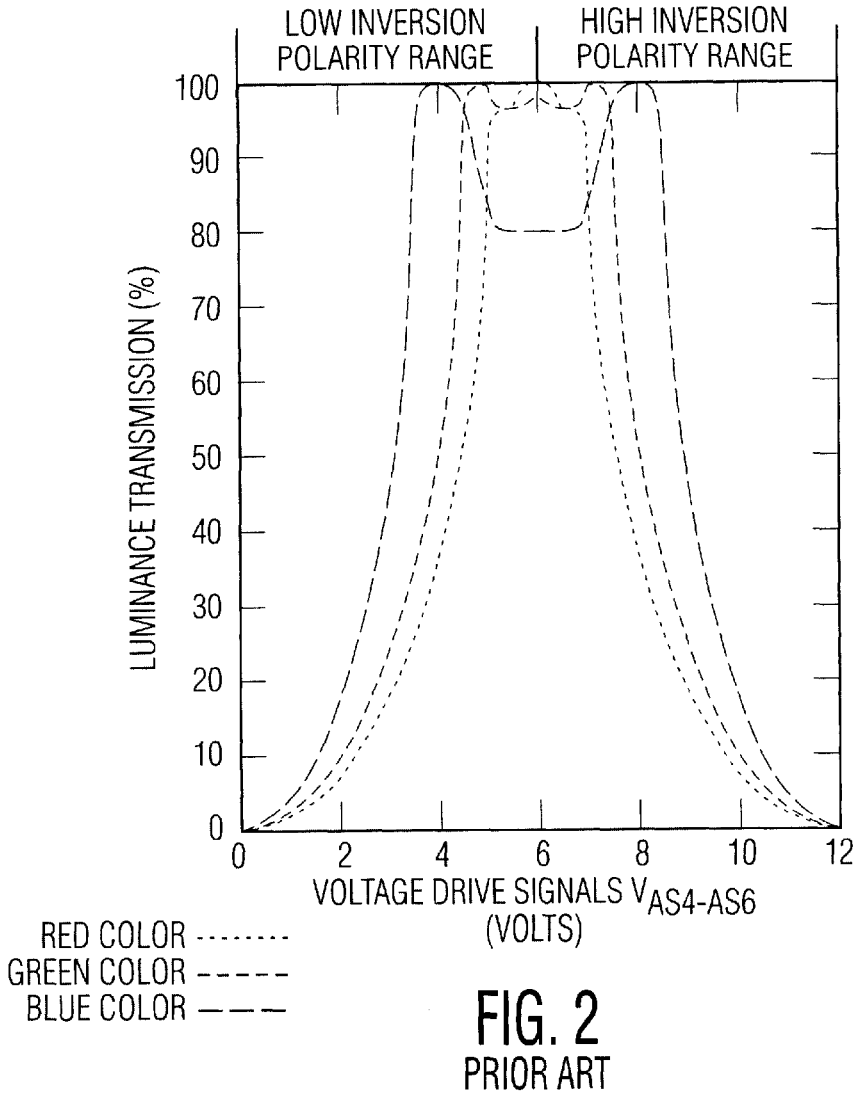
FIG. 2 PRIOR ART
FIG. 2 is a graph exemplary illustrating a luminous response curve of the FIG. 1 liquid crystal display in terms of a red color component, a green color component, and a blue color component as a function of the levels of corresponding voltage drive signals.
Figure 3:
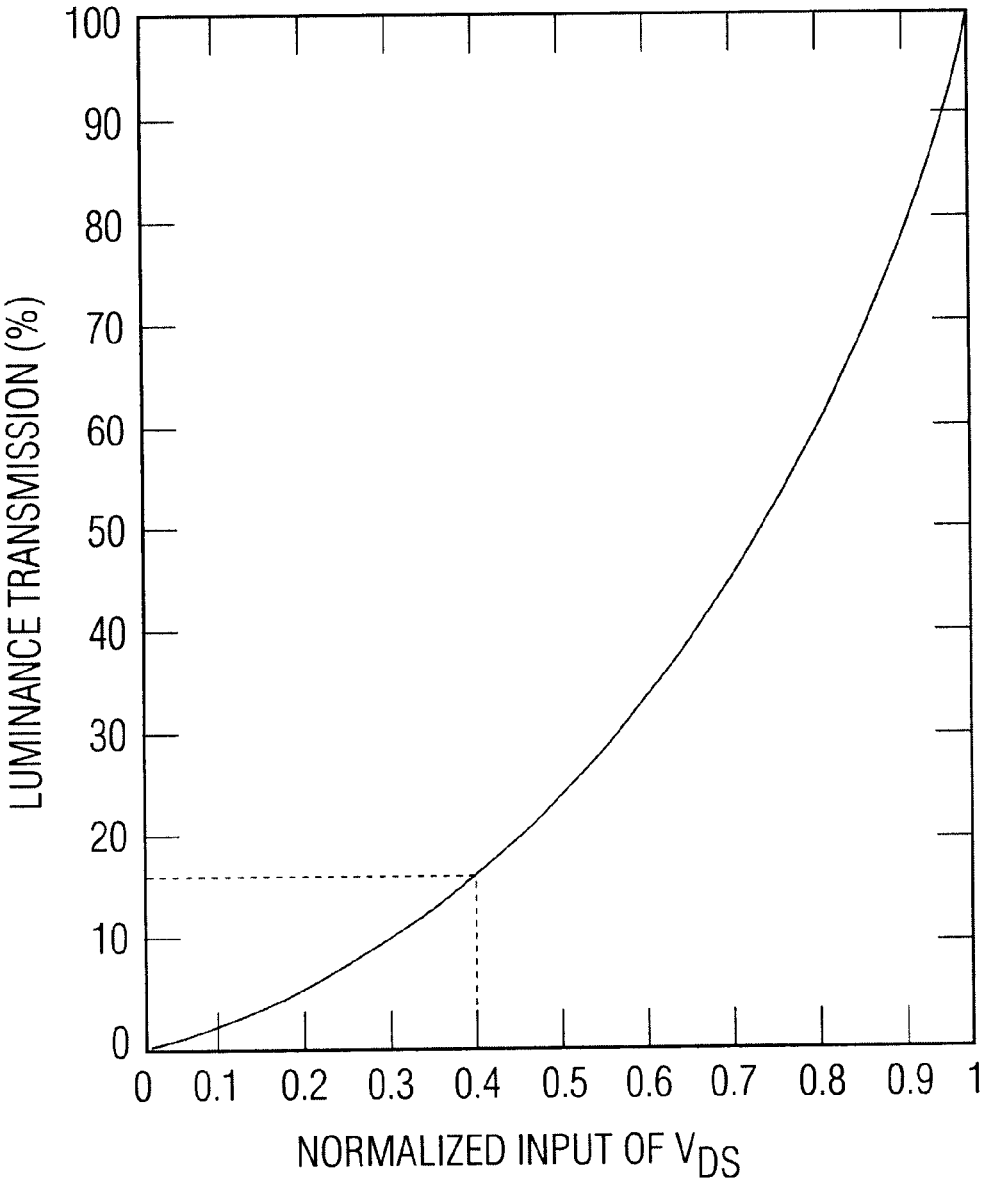
FIG. 3 PRIOR ART
FIG. 3 is a graph exemplary illustrating a desired luminous response curve of a luminous output from the FIG. 1 LCD device as related to a voltage data signal.
Figure 4:
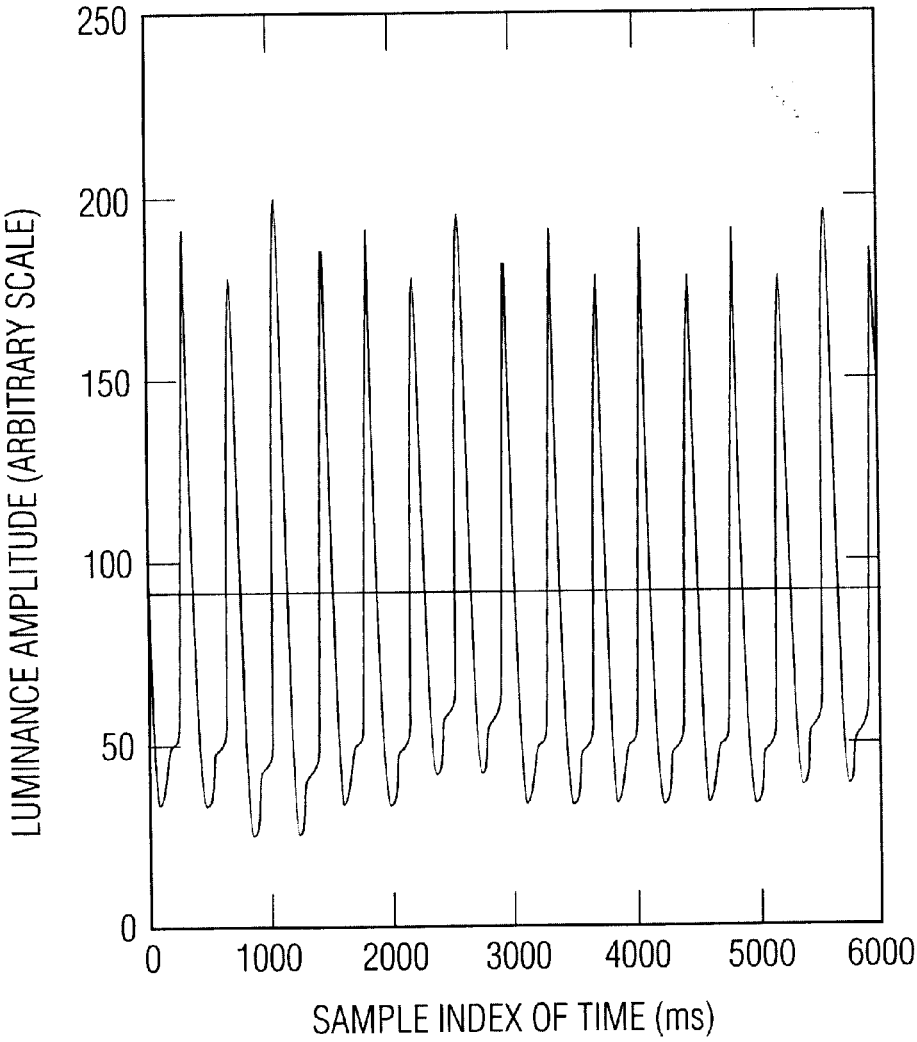
FIG. 4 PRIOR ART
FIG. 4 illustrates an exemplary time-based luminance amplitude measurement of the luminance output of the FIG. 1 LCD device as related to a gray level input indicated by a voltage data signal.

During a stage S50 of flowchart 40, computer 30 is operated to modify the appropriate gamma lookup in response to voltage measurement signal $V_{MS}$. The modification reflects the pair of drive voltage levels corresponding to the gray level indicated by the data voltage level. The pair of drive voltage levels have opposing polarities relative to a reference voltage level of six (6) volts with the benefit being a development of a gamma lookup table that facilitates the proper average luminance that is desired for the graylevel indicated by the data voltage signal as shown in FIG. 3 and equalizes the peaks of the luminance waveform as shown in FIG. 9.

Stages S44-S50 are then repeated as needed in any order whereby the preliminary red color gamma lookup table of FIG. 8A is transformed to the red color gamma lookup table of FIG. 6A, the preliminary green color gamma lookup table of FIG. 8B is transformed to the green color gamma lookup table of FIG. 6B, and the preliminary blue color gamma lookup table of FIG. 8C is transformed to the blue color gamma lookup table of FIG. 6C. The gamma lookup tables of FIGS. 6A–6C are then setup within gamma circuit 10 (FIG. 5) whereby the display driver can implement the inversion flicker compensation to luminous output 14 (FIG. 5) as emitted by LCD device 13 (FIG. 5).

While the embodiments of the present invention disclosed herein are presently considered to be preferred, various changes and modifications can be made without departing from the spirit and scope of the present invention. The scope of the present invention is indicated in the appended claims, and all changes that come within the meaning and range of equivalents are intended to be embraced therein.

What is claimed is:

1. A display apparatus comprising:

a. a liquid crystal display device operable to emit a predetermined luminous output in response to either a higher or lower drive signal voltage relative to a reference voltage; and b. a display driver operable to provide either the higher or lower drive signal voltage to the liquid crystal display device in response to a data signal representative of the predetermined luminous output;

said display driver including a gamma lookup table for respective values of the higher and lower drive signal voltages, said values being corrected to compensate for different magnitudes of attenuation of the higher and lower drive signal voltages in operation of said apparatus.

2. A display apparatus as in claim 1 where, in operation, the higher and lower drive signal voltages are alternately provided to the liquid crystal display device during successively displayed video frames, said corrected values compensating for inversion flicker.

3. A display apparatus comprising:

a. a liquid crystal display device operable to emit a plurality of predetermined luminous outputs, each of said predetermined luminous outputs being emitted in response to either a corresponding higher or lower drive signal voltage relative to a reference voltage; and b. a display driver operable to provide any of the higher or lower drive signal voltages to the liquid crystal display device in response to data signals representative of the predetermined luminous outputs;

said display driver including a gamma lookup table for values of the higher and lower drive signal voltages corresponding to said predetermined luminous outputs, said values being corrected to compensate for different magnitudes of attenuation of the higher and lower drive signal voltages in operation of said apparatus.

4. A display apparatus as in claim 3 where, in operation, the higher and lower drive signal voltages are alternately provided to the liquid crystal display device during successively displayed video frames, said corrected values compensating for inversion flicker.

5. A method of operating a display apparatus including a liquid crystal display device operable to emit any one of a plurality of predetermined luminous outputs, each corresponding to either one of a respective pair of higher or lower drive signal voltages relative to a reference voltage, said method comprising:

a. providing a data signal representative of one of the predetermined luminous outputs;

b. providing a gamma lookup table for respective values of the higher and lower drive signal voltages corresponding to the plurality of predetermined luminous outputs, said values being corrected to compensate for different magnitudes of attenuation of the higher and lower drive signal voltages in operation of said apparatus;

c. in the gamma lookup table, selecting one of the values of the pair of higher and lower drive signal voltages corresponding to the predetermined luminous outputs represented by said data signal;

d. providing a drive signal voltage having the selected value to the liquid crystal display device.

6. A method as in claim 5 where, in operation, the higher and lower drive signal voltages are alternately provided to the liquid crystal display device during successively displayed video frames, said corrected values compensating for inversion flicker.

7. A method as in claim 5 where, in each of a plurality of frame periods, the steps are repeated for each of at least first and second color components.

8. A method of operating a display apparatus including a liquid crystal display device operable to emit any one of a plurality of predetermined luminous outputs, each corresponding to either one of a respective pair of higher or lower drive signal voltages relative to a reference voltage, said method comprising:

a. providing a data signal representative of one of the predetermined luminous outputs in first and second frame periods;

b. successively providing to the liquid crystal display device, in the first and second frame periods, the higher and lower drive signal voltages corresponding to the predetermined luminous output represented by said data signal, , said values being corrected to compensate for different magnitudes of attenuation of the higher and lower drive signal voltages in operation of said apparatus.

9. A method as in claim 8 where, in each of a plurality of frame periods, the steps are repeated for each of at least first and second color components.

* * * * *